United States Patent [19]

Guier

[11] 4,448,246

[45] May 15, 1984

[54] APPARATUS FOR SETTING CASING IN AN OIL WELL

[76] Inventor: William Guier, 3100 E. 71st St., Tulsa, Okla. 74105

[21] Appl. No.: 397,516

[22] Filed: Jul. 12, 1982

[51] Int. Cl.[3] ..... E21B 15/00; E21B 19/02

[52] U.S. Cl. ..... 166/77; 254/30; 254/399; 173/29

[58] Field of Search ..... 166/77; 254/29 R, 30, 254/30, 285, 326, 327, 399; 173/29, 46; 175/171

[56] References Cited

U.S. PATENT DOCUMENTS 1,894,912 1/1933 Otis ..... 254/29 R X 1,972,635 9/1934 Whinnen ..... 254/29 R X

FOREIGN PATENT DOCUMENTS 353168 10/1937 Italy ..... 254/30

*Primary Examiner*—Ernest R. Purser

*Attorney, Agent, or Firm*—Arthur L. Wade

[57] ABSTRACT

A drilling rig with conventional capacity for working a drilling string is linked to a casing string with a block and tackle which provides sufficient mechanical advantage for the drilling rig to suspend the casing string in the oil well.

2 Claims, 4 Drawing Figures

APPARATUS FOR SETTING CASING IN AN OIL WELL

TECHNICAL FIELD

Figure 1:
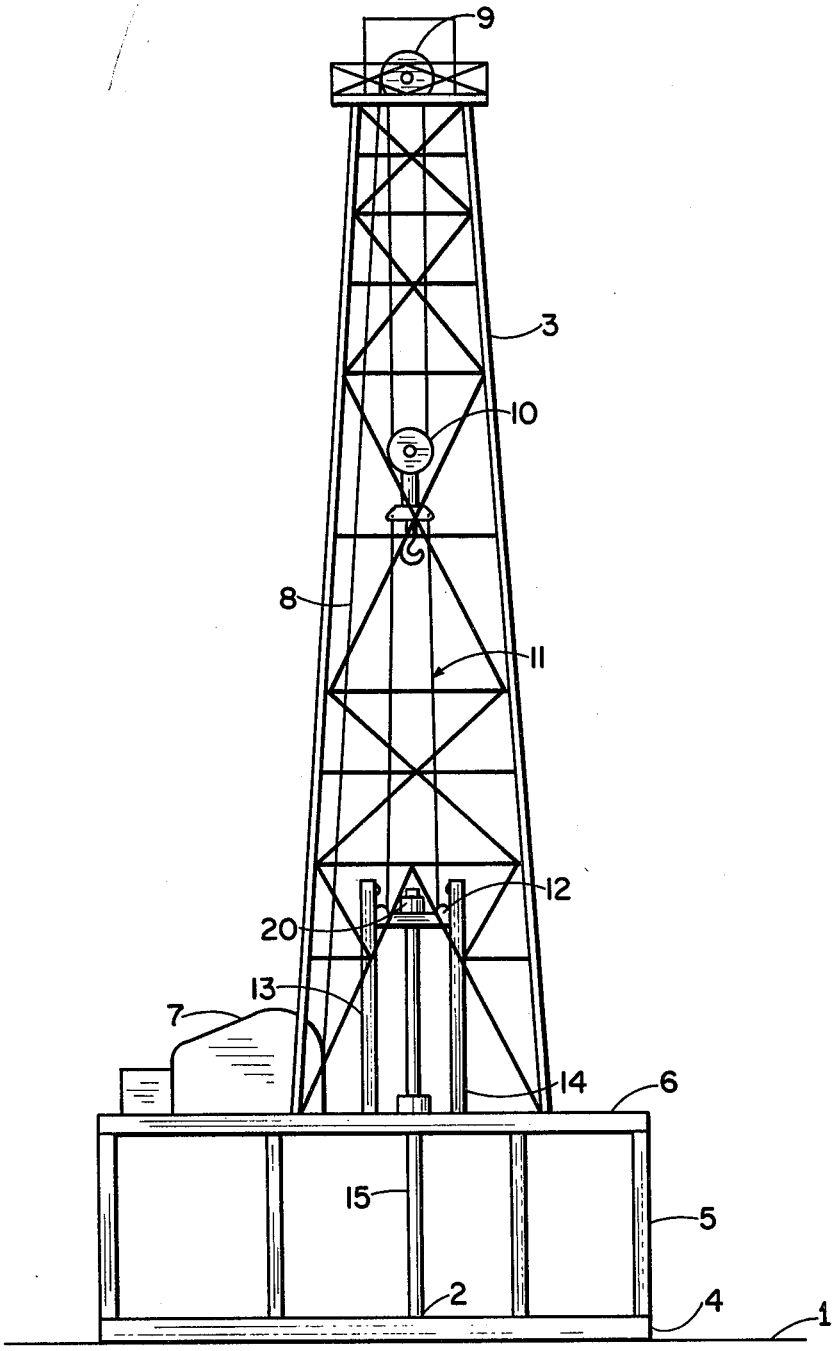

The present invention is related to a mechanical hoisting system for working a string of surface casing in an oil well powered from a conventional drawworks and derrick, or mast.

More particularly, the invention relates to mounting a system of pulleys and metallic cable above the opening of an oil well to function as a mechanical linkage between conventional drawworks and derrick, or mast, and the casting string as it is set.

BACKGROUND ART

There are oil well drilling rigs now available to drill up to depths past 30,000 feet. To drill to these depths, the drawworks and derrick must work with tremendous weights of drill pipe extending from the surface to those depths.

The drawworks and derrick having the load capability of working the drill string to past the 30,000 foot level is still short of the capability of working the required casing string which can have a weight up to 1,000 tons. Of course, the drawworks and derrick could be built to support up to 1,000 tons of casing string, but its capacity would not only be uneconomical for the drilling operation, but would seriously lower the drilling efficiency of the rig.

It is well known to mount a hydraulic casing jacking system adjacent the well bore and within the drilling derrick. With a separate source of hydraulic power fluid, this casing jacking system has the capacity to work the casing string within the well bore. Inarguably, when the hydraulic system is operative, it assumes the duty of raising and lowering the casing string from the drilling derrick and drawworks. However, this system has all of the disadvantages and vulnerability of hydraulic systems.

It is proposed that a mechanical linkage between the casing string and the drilling drawworks be established. With the advantage of a mechanical linkage actuated by the drilling rig, the hydraulic system can be effectively supplanted. In other words, the hydraulic system can be effectively eliminated with a mechanical system which is comparably efficient to the hydraulic system, a good deal less expensive, a good deal less vulnerable to malfunction, and easier to transport and set at the well bore.

DECLARATION OF THE INVENTION

The present invention contemplates mounting a pair of posts on adequate foundations adjacent the surface opening of a well bore as a component of a system of pulleys and metallic cables between a casing elevator and the traveling block of a conventional drilling rig.

The invention further contemplates that the posts be located on prepared foundations directly beneath the crown block so that the cable from the drum of the drawworks will run conveniently through the crown block and down to the traveling block so single joints of casing may be swung through the door of the derrick for bringing them to the string worked in the well bore.

Other objects, advantages and features of the invention will become apparent to one skilled in the art upon consideration of the written specification, appended claims and accompanying drawings.

BRIEF DESIGNATION OF THE DRAWING FIGURES

Figure 2:
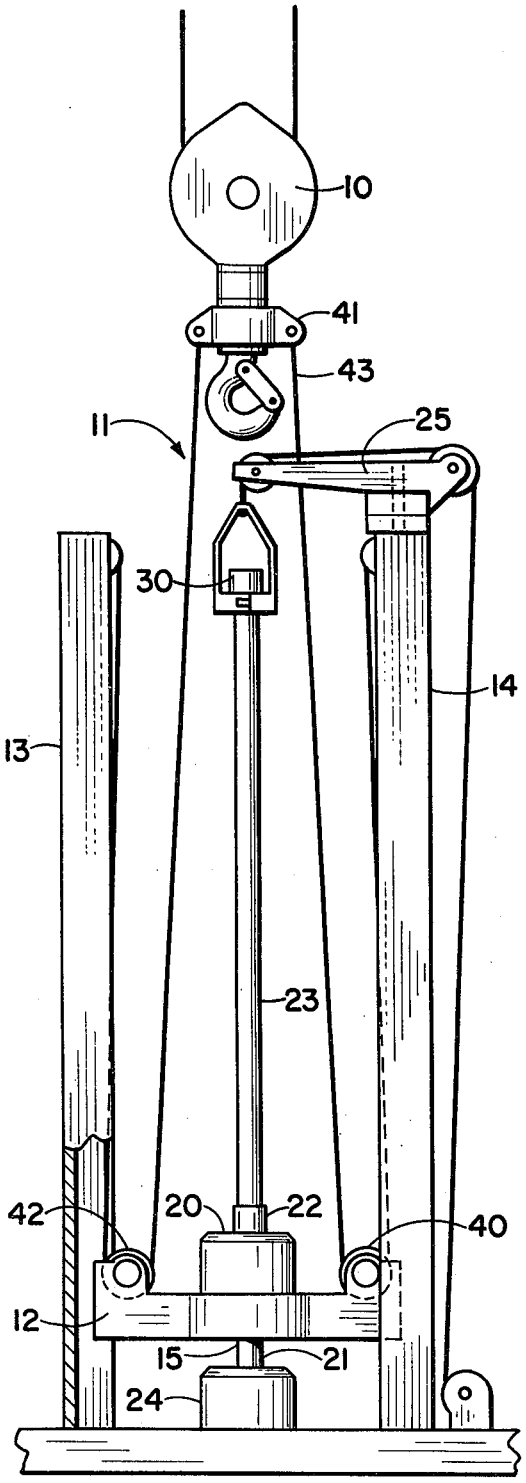
Figure 3:
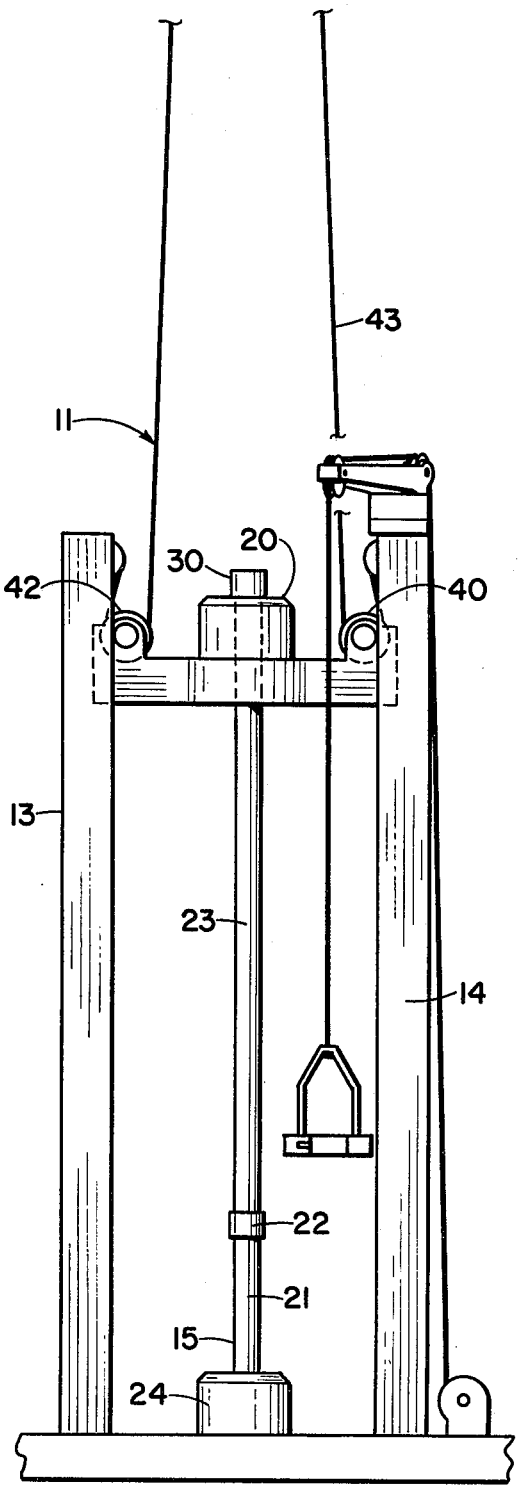
Figure 4:
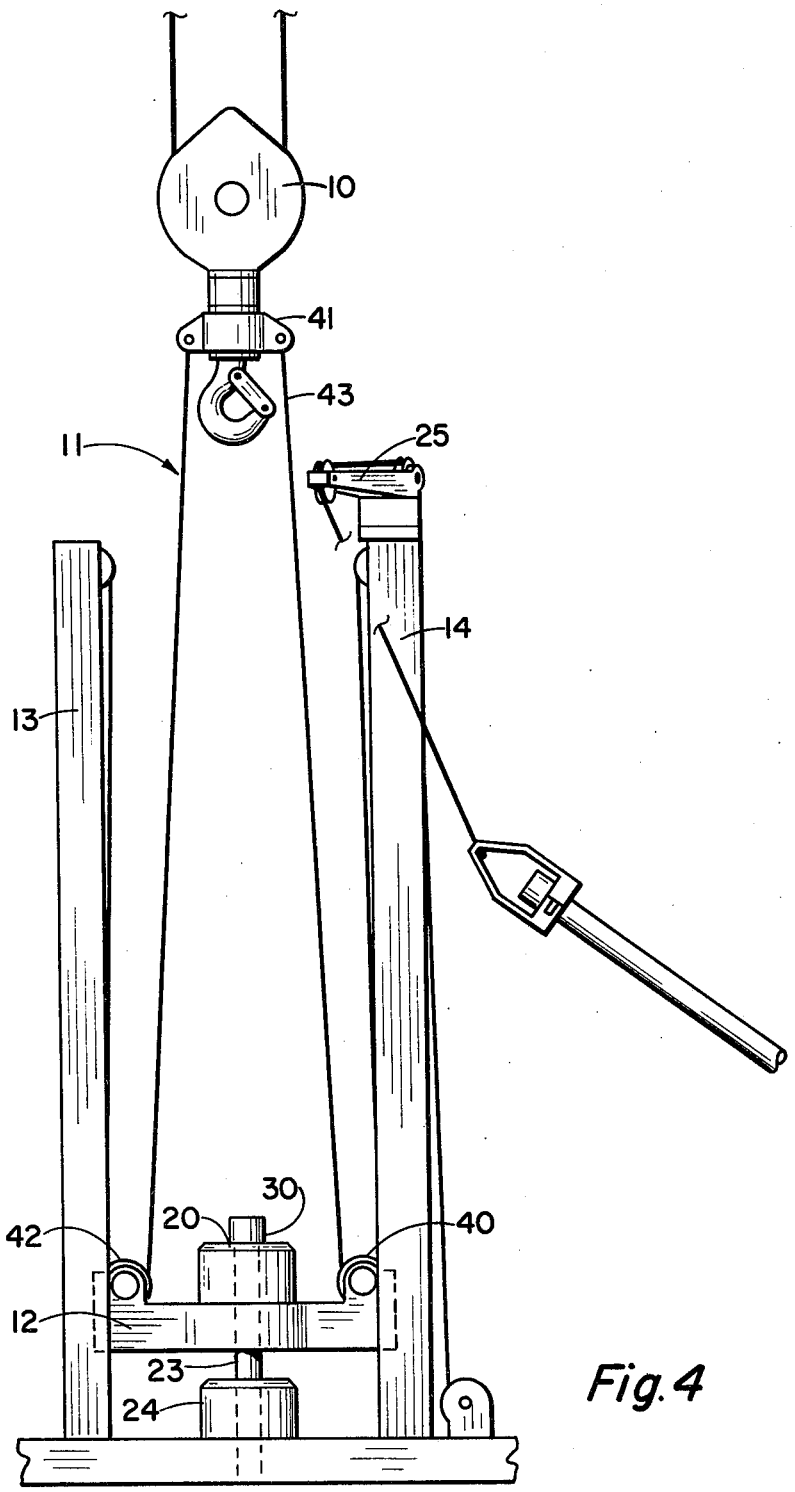

FIG. 1 is a drilling rig linked by its traveling block to a casing string with tackle embodying the present invention; and FIG. 2 is a sectioned elevation of part of the structure of FIG. 1 showing the casing suspended by its elevator and a new joint added as a part of the casing string; and FIG. 3 is the structure of FIG. 2 in which the cross-member connected to the traveling block is positioned at the top of the newly added casing joint; and FIG. 4 is a structure of FIGS. 2 and 3 with the cross piece connected to the traveling block lowered to the well opening while a new casing joint is being lifted from the stored supply.

PREFERRED MODE WITH WHICH TO EMBODY THE PRESENT INVENTION

Terms and Technology

The present invention is bound to the conventional drilling rig. The drawworks, drilling mast, crown block, traveling block, etc. of the conventional drilling rig will be referred to because it is with these elements that the present invention makes a combination with which to suspend the string of casing as the string is made up and lowered into the previously bored well. The link with the casing embodies the present invention in enabling the conventional drilling rig to suspend the tremendous weight of the casing string and lower it into the well as joint upon joint is added to the top of the string.

The term "mechanical advantage" is employed because it is with the embodiment of the invention that the drilling rig having the normal capacity for working drill pipe is able to work the greater weight of the casing string. This link, with its mechanical advantage, is termed in its more simple sense a "block and tackle" in that it is made up of the conventional elements of pulleys and wire ropes. Precisely how many pulleys are incorporated into an actual reduction to practice of the tackle does not bear upon the uniqueness of the invention. The wire rope could extend from a stable anchor adjacent the well through a pulley connected to the casing string by an elevator and thence to the traveling block of the drilling rig. More elaborately, two or more pulleys could be used, but this is a matter of design within the concept of the invention.

The stable anchor will be referred to as a post system which will preferably be embodied in a pair of posts vertically extended up from the drilling rig substructure to a predetermined height. A cross piece is arranged to travel the vertical length of these posts and will be described as having a central aperture up through which the top joint of the casing string extends and to which the casing is connected through an elevator structure carried on the upper surface of the cross piece. Thus, the block and tackle, as an essential element of the invention, extends between the top of this post system down to the cross piece carrying the elevator on its upper surface and up to the traveling block.

It is anticipated in the disclosure of this invention that the casing will be set, joint by joint, to extend the string down into the bore of the well to the predetermined depth at which it will be cemented into place. It is not anticipated there will be a subsequent need for removing the casing although this is, of course, possible. Usually, casing, once set, is looked upon as a permanent structure of the well. As has been said with monotonous regularity, the ultimate function of the invention is to provide for this tremendous weight of the lengthening casing string to be suspended while a new joint is added and lowered in preparation for the addition of a succeeding joint. All other functions of associated apparatus are ancillary to this basic function of the invention.

THE DRILLING RIG AND THE INVENTION

FIG. 1 provides an overview of the standard, conventional drilling rig sized and arranged to manipulate the drilling string in making hole. From the ground surface 1 the drilling hole 2 extends down to the producing geological structure. The drilling string has been removed because it is time to set the surface casing and cement it into place. The drilling rig is characterized by the mast 3 mounted upon substructure 4 extending up from the foundation adjacent the well bore 2. Sturdy foundation columns 5 extend up from the ground surface as a part of the substructure supporting a drilling platform 6.

The source of power for running the drill string, and now the casing string, is represented as drawworks 7. By well known arrangements, cable 8 extends up from the drum of the drawworks through the crown block 9 on the top of the mast 3. Through the crown block, the cable 8 extends down to traveling block 10 to which everything going in and coming out of the well bore is attached by one means or another.

In this present environment for the invention, the traveling block is connected to the mechanical link, represented by block and tackle 11 which extends down to linkage with cross member 12 whose path of travel is aligned with the well bore and the crown block 9, being held in this path by posts 13 and 14 extending vertically up from the substructure.

As shown in FIG. 1, cross member 12 is at the upper end of its path, connected to support the casing string 15 preparatory to lowering the upper end of the string down to the level of the drilling platform 6. Following FIG. 2 will show this cross member in its path where it will be released from the casing string after the casing string has been locked to the drilling platform by a spider structure. While the cross member is at its lower position as shown in FIG. 2, a new joint will be added to the casing string preparatory to removing the released cross member and its elevator to the top of the added casing joint.

NEW CASING JOINT IN PLACE

FIG. 2 discloses the structure, including the invention, positioned at that point in its cycle of operation where a new, single joint of casing has been added and is in place on the upper end of the casing string depending down the well bore.

The posts 13 and 14 are based across the well bore, on each side of the well bore, to function in parallel as a track for the traveling cross member 12. Cross member 12 mounts the casing elevator 20 on its upper surface, the elevator positioned and arranged to provide passage therethrough for the casing joints and then actuated to grip each casing joint below the box on its upper end. The cross member 12 and the elevator 20 may be regarded as a unit in that the elevator remains supported on the upper surface of the cross member receiving therethrough the casing joints and string and gripping the casing and joints at the proper times in their cycle of operation.

In FIG. 2, cross membr 12 is at the lower end of its vertical travel, elevator 20 closed to grip the upper joint 21 below its box 22 as the upper end of the casing string 15 is suspended in the well bore. Casing joint 23 is in place, threaded into box 22 to become the new upper end of the string 15 extending above the surface. Slips or spider 24 are shown set between the joint 21 and the drilling platform to lock the two together so that the elevator can be released from this joint preparatory to moving its supporting cross member 12 vertically upward so the elevator may grip the casing joint 23 below its box.

Joint 23 has been placed in its position shown in FIG. 2 by elevator mechanism 25 mounted from the top of the post 14. This mechanism for swinging joint 23, and subsequent joints, through the door of the mast or derrick may take any number of convenient forms. The function of the structure is simply to secure single joints of casing from a stored supply and swing them through the door of the mast into the position occupied by joint 23 in FIG. 2. Of course, the spinning structure to thread string 15 and joint 23 together, as well as tongs to tighten these joints, are not shown as needless encumbrances to the drawing disclosure of the invention.

LOWERING THE CASING STRING

FIG. 3 is the structure of FIG. 2 with the cross member 12 and its elevator 20 raised to the upper end of its vertical path to close the elevator about the casing joint 23 added just below its box 30. Of course, as explained in FIG. 2, while the cross member has been shifted to its FIG. 3 position, the casing string has been immobilized in the well by the slip or spider structure between the string and the drilling platform.

The traveling block 10 of FIG. 2 is not shown in FIG. 3, having been raised well out of sight on the end of the cable of 11. With the casing string 15 clamped to the cross member 12 by its elevator 20, the slip-spider can now be removed preparatory to lowering the casing string into the well bore. When this lowering is completed by the drilling rig through the tackle embodying the invention, the second step of the procedure is completed.

ADDING A CASING JOINT

FIG. 4 is the structure of FIGS. 2 and 3 following the anticipated lowering of the casing string 15 of FIG. 3. Traveling block 10 has again appeared as it has lowered the casing string 15 so that the upper box of the top joint appears just above the drilling platform 6. Again, the slips-spider 24 are placed between the upper casing joint 21 of the string and the drilling platform 6 and a new casing joint 31 has been snatched from inventory by joint elevator 25 and is disclosed as swinging into the FIG. 2 position to be added to the casing string. The cycle of operation is completed by this step disclosed in FIG. 4. First there was the FIG. 2 step of threading the new joint into place on the upper end of the casing string, then the FIG. 3 step of lowering the newly added joint into the well as the new upper end of the casing string, and finally, this FIG. 4 step of moving a new joint through the door of the mast to add it to the casing string.

CONCLUSION

Again it is emphasized that the vertical shuttle of the cross member 12 and its casing elevator 20 is under the control of the link between the cross member 12, the posts 13 and 14, and traveling block 10. As most clearly disclosed in FIG. 3, this link 11 comprises pulley 40, clamp 41, pulley 42 and cable 43. Cable 43 extends from the top of post 14, down through pulley 40, up through clamp 41, down through pulley 42 and up to the top of post 13. Thus arranged, the link 11, as a block and tackle, provides a two-to-one mechanical advantage between traveling block 10 and cross member 12. With this mechanical advantage, the drilling rig, through its cable 8 is able to suspend the casing string 15 in the well bore as the string is lowered with added joints. The specific arrangement and number of pulleys provided in this link 11 is a matter of design. It is expected that the cable 43 will be a wire rope of extremely high tensile strength to give this link the capacity sufficient to support the casing string from the traveling block of the drilling rig.

It is to be emphasized that this mechanical link 11 provides several advantages over the prior art's employment of hydraulic jacks. There is no better technique to emphasize these advantages than a systematic listing of them as provided below:

1. Expands capability of rigs of conventional capacity to run heaviest casing string.
2. Is an economical rugged, all mechanical system which utilizes rig capabilities for power.
3. Does not use hydraulics. Requires neither auxiliary hydraulic power system nor large, expensive, easily damaged hydraulic rams.
4. Breaks down into convenient sized, rugged, easily handled packages.
5. Fast rig-up and rig-down—does not require breaking of hydraulic rams.
6. Is not weather sensitive—unaffected by temperature or climatic conditions.
7. Fast—quick and easy to rig up and down. Fast and easy to operate because driller uses his normal hoisting and braking controls.
8. Easy to maintain and keep in repair. Simple, rugged, mechanical part s which can be serviced by rig personnel.
9. Casing, except for extra long sizes, can be set a full joint at a time, eliminating the time lost taking "bites", as with hydraulic jacks.

The history of rotary drilling has spanned the period from the first of the century to the present. Beginning with the rotary table, powered by a drawworks, improvements have been made in the form of "add-ons". Piece-by-piece, the spinning chain, spinners, slips, spider, tongs, and other tools have been drawn into the arena of the drilling floor. In this headlong rush to meet the many needs for handling drill pipe, little or no creativity has been generated to integrate these "add-on" tools, and their functions. Further, no real success has been attained in improving the initial designs of these "add-on" tools. This present invention is a classic example of my success in making basic improvements to the various drilling tools. I took a long look at the characteristics of the hydraulic system with which casing strings are presently set and generated the concept of this invention which overcomes the weaknesses, disadvantages and inconveniences of the hydraulic system while utilizing the capacity of the conventional drilling rig.

From the foregoing, it will be seen that this invention is one well adapted to attain all of the ends and objects hereinabove set forth, together with other advantages which are obvious and inherent to the apparatus.

It will be understood that certain features and subcombinations are of utility and may be employed without reference to other features and subcombinations. This is contemplated by and is within the scope of the invention.

As many possible embodiments may be made of the invention without departing from the scope thereof, it is to be understood that all matter herein set forth or shown in the accompanying drawings is to be interpreted in an illustrative and not in a limiting sense.

I claim:

1. In combination with a drilling rig of sufficient capacity for drilling the bore of an oil well with a drawworks and mast supporting a crown block through which the cable from the drawworks runs through the crown block in suspension of the traveling block over the well bore, a string of casing in the well bore, a mechanical linkage connecting the traveling block and the casing, including a pair of posts vertically extended upward from the ground on each side of the well bore and a pair of pulleys connected to the casing string with a cable running from the upper portion of each post down through the pair of pulleys and up to the traveling block, whereby the weight-bearing capacity of the mechanical linkage is great enough to enable the drawworks and cable of the drilling rig to suspend the casing string in the well bore by the mechanical advantage of the linkage.

2. The mechanical linkage of claim 1 in which the cable is metallic and has a high tensile strength.

* * * * *